United States Patent [19]

Spencer et al.

[11] Patent Number: 4,739,904

[45] Date of Patent: Apr. 26, 1988

[54] DISPENSER PUMP

[75] Inventors: Jeffrey W. Spencer, Kirby Muxloe; Anthony Wass, Stamford, both of Great Britain

[73] Assignee: The English Glass Company Limited, Leicester, England

[21] Appl. No.: 929,475

[22] Filed: Nov. 12, 1986

[30] Foreign Application Priority Data

Nov. 11, 1985 [GB] United Kingdom ..... 8527775

[51] Int. Cl.[4] ..... B67D 5/00

[52] U.S. Cl. ..... 222/109; 417/439; 417/460; 222/318; 222/383; 222/481

[58] Field of Search ..... 222/109, 318, 375, 383, 222/379, 382, 372, 111, 478, 481, 380; 417/439, 460; 92/86.5

[56] References Cited

U.S. PATENT DOCUMENTS

| | | | |
|---|---|---|---|
| 1,929,564 | 10/1933 | Rolph | 222/383 X |
| 2,906,300 | 9/1959 | Becher | 222/109 X |
| 3,337,096 | 8/1967 | Brown | 222/383 X |
| 4,640,443 | 2/1987 | Corsette | 222/375 X |

FOREIGN PATENT DOCUMENTS

| | | | |
|---|---|---|---|
| 524175 | 4/1931 | Fed. Rep. of Germany | 222/109 |

*Primary Examiner*—Joseph J. Rolla
*Assistant Examiner*—Nils E. Pedersen
*Attorney, Agent, or Firm*—Cushman, Darby & Cushman

[57] ABSTRACT

A dispenser pump has pump chamber (34) whose volume is variable to draw up or discharge material, by the axial movement of a cup (25) on a stationary hollow stem (12). The seal (16) between them slides on an inner wall of the cup. A collector (30) at the lower end of the cup causes any material leaked past the seal to be guided inwardly to apertures (33) where it may drop to a body part (9) and pass via apertures (11') to a container (1) of the material.

7 Claims, 3 Drawing Sheets

DISPENSER PUMP

This invention relates to a dispenser pump which is especially although not exclusively designed for the dispensing of materials which are aggressive and/or expensive. In either case, transfer of the materials to the outside of the pump through leakage or wear will have undesirable consequences.

We find that we can provide a pump which avoids the dangers or waste for the abovementioned reasons by in effect inverting the normal construction of such a pump - which has a piston working within a cylinder - such that suction to draw material to be dispensed into a pump chamber and pressure to cause it to be dispensed to the outside of the pump is caused by axial movement of a cup about a central stem, with hermetic sealing between the cup and the stem.

At the bottom of the cup, we may provide a special collector part to guide any material which has escaped through the seal towards a return passage at the foot of the pump leading back to a container of the material drawn by the pump.

To assist return of the collected material back into the container we may further arrange that venting means for allowing ingress of air into the container to balance material lost from it are also the aperture or apertures which are used for return of leaked and collected material. That is to say inward flow of air as a result of material having been drawn from the container will cause or assist return flow of any collected escaped material.

A preferred seal construction between the cup and the stem comprises a seal ring arranged stationary on the stem to wipe the internal surface of the cup as it reciprocates axially in relation to the stem, and a capping ring at the mouth of the cup having a downwardly inclined frusto conical portion to act as the said collector part and having at least one aperture at its lower end.

An inlet valve for the dispenser pump may be a conventional ball valve mounted at the head of the draw tube by which the suction pump draws material from a container on which it is mounted; an outlet valve from the dispenser pump may be a spring-loaded non return valve mounted in the outlet nozzle, the outlet nozzle communicating with the stem in a base portion thereof near to the inlet valve.

There may also be means for providing an additional hermetic seal of the pump chamber at a time when the cup is in a closed-down position.

A particular embodiment of the invention will now be described by reference to the accompanying drawings wherein.

Figure 1:
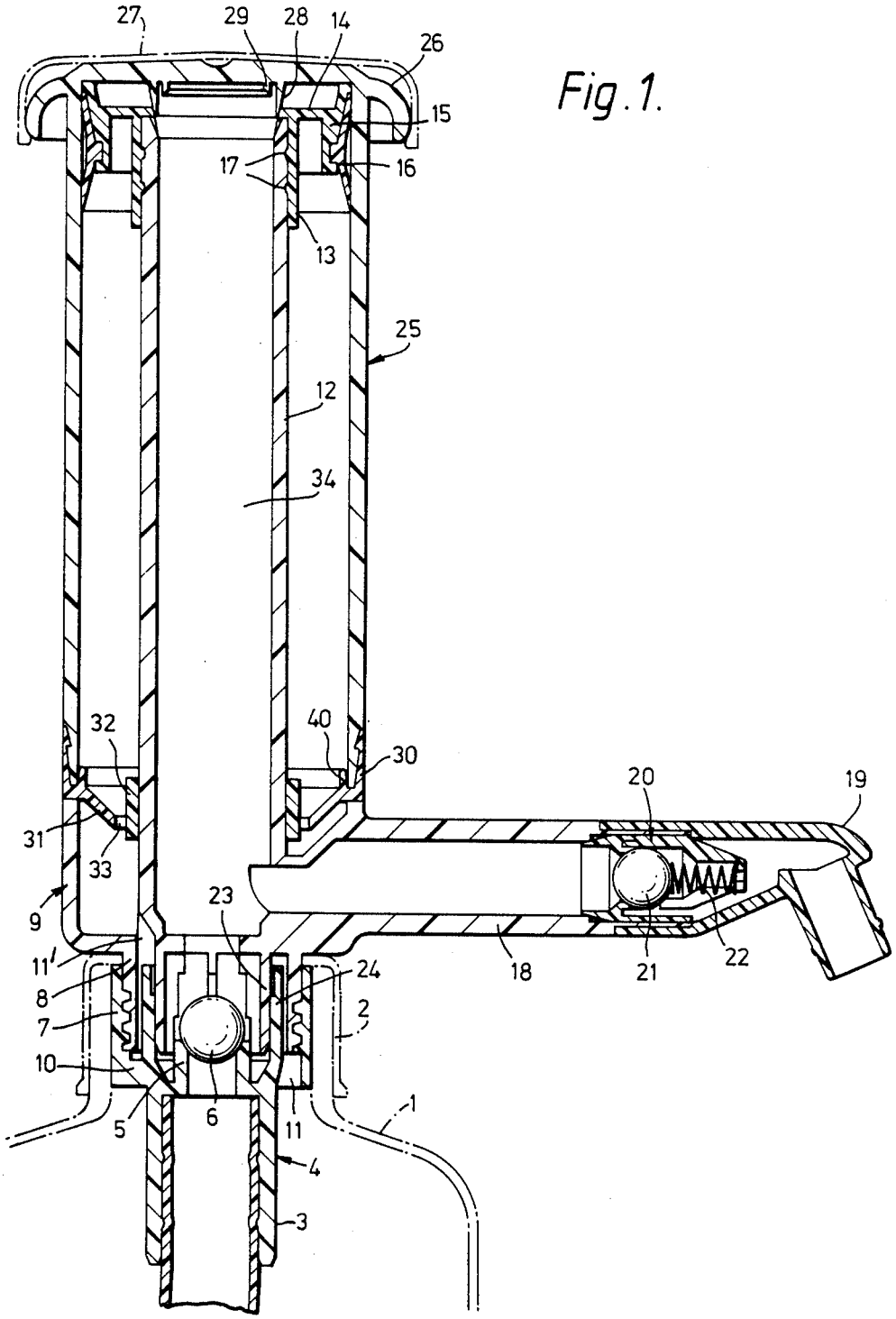
FIG. 1 is a diametric section through the embodiment in the position where the cup is closed down on the stem.

The dispenser pump to be described is for dispensing of agro-chemicals which are both likely to be toxic or otherwise harmful to humans in their concentrated form and be extremely expensive.

A container 1 for the agro-chemicals is indicated, to the head of which can be secured a cap 2 which need not be part of the dispenser pump assembly. This holds the assembly onto the container such that a draw pipe fitting within a sleeve 3 of a base part 4 of the assembly projects to near the bottom of the container. In an inner ring 5 of the base part 4 is provided a seat for a conventional ball 6 of a non return valve which permits flow in the upward direction. An outer ring 7 of the base part 4 has an internal face with screw threading or annular ridges for the engagement of a skirt 8 of a body part 9 of the pump. In a flange 10 which forms a floor joining the outer ring 7 into the base part 4 and also in the floor of the body part 9 there is one or more apertures 11, 11'.

The body part 9 has an upwardly projecting hollow cylindrical stem 12 which is to form part of a pump chamber. At its top end the stem has fitted on its external surface a collar 13 which extends by means of a flange 14 to a mounting 15 for a two-legged seal ring 16. The mounting 15 extends axially beyond one leg of the seal ring to protect it against being struck by the head of the cup. The collar is preferably snap fitted onto the top end of the stem 12 and held there by detent ridges/-recesses 17.

At the bottom portion of the stem, there projects radially the root 18 of an outlet nozzle which terminates in any suitable end fitting 19 at the outboard end, the securing of which—preferably by means of snap fitting detents—allows the insertion of a non return valve module 20 which includes a conventional ball 21 spring loaded by a spring 22 to permit movement of material from the root part 18 outwardly to the nozzle but only when the spring pressure of the spring has been overcome.

From the floor of the body part 9 below the stem there also projects a skirt 23 which is to fit snugly within a middle ring 24 of the base part 4 and define a chamber enclosing the ball 6.

The pumping action of the dispenser is assured by a cup 25 mounted outside the stem. Its inner cylindrical surface is wiped by the sealing ring 16 to form a hermetic seal. At its top end the head 26 of the cup 25 has an outwardly projecting flange to act as a handle and this may be covered by some decorative or protective plate 27. A thin annulus 28 on the undersurface of the cup head 26 may engage tightly within the chamfered inner periphery of the collar 13 and may also together with a smaller inner annulus 29 provide a seat for a spring which may be if desired housed within the hollow of the stem 12.

At its lowermost end the cylinder 25 has a collector part 30 snapped onto it, the part 30 including a downwardly inclined frusto conical portion 31 supporting a guide collar 32 which is to slide upon the outer surface of the stem 12 and which portion 31 has apertures 33 at its lowermost point. A lip 40 inside the cup engages the seal ring 16 (FIG. 2) to prevent damage if the cup is inadvertently pulled too far.

Figure 2:
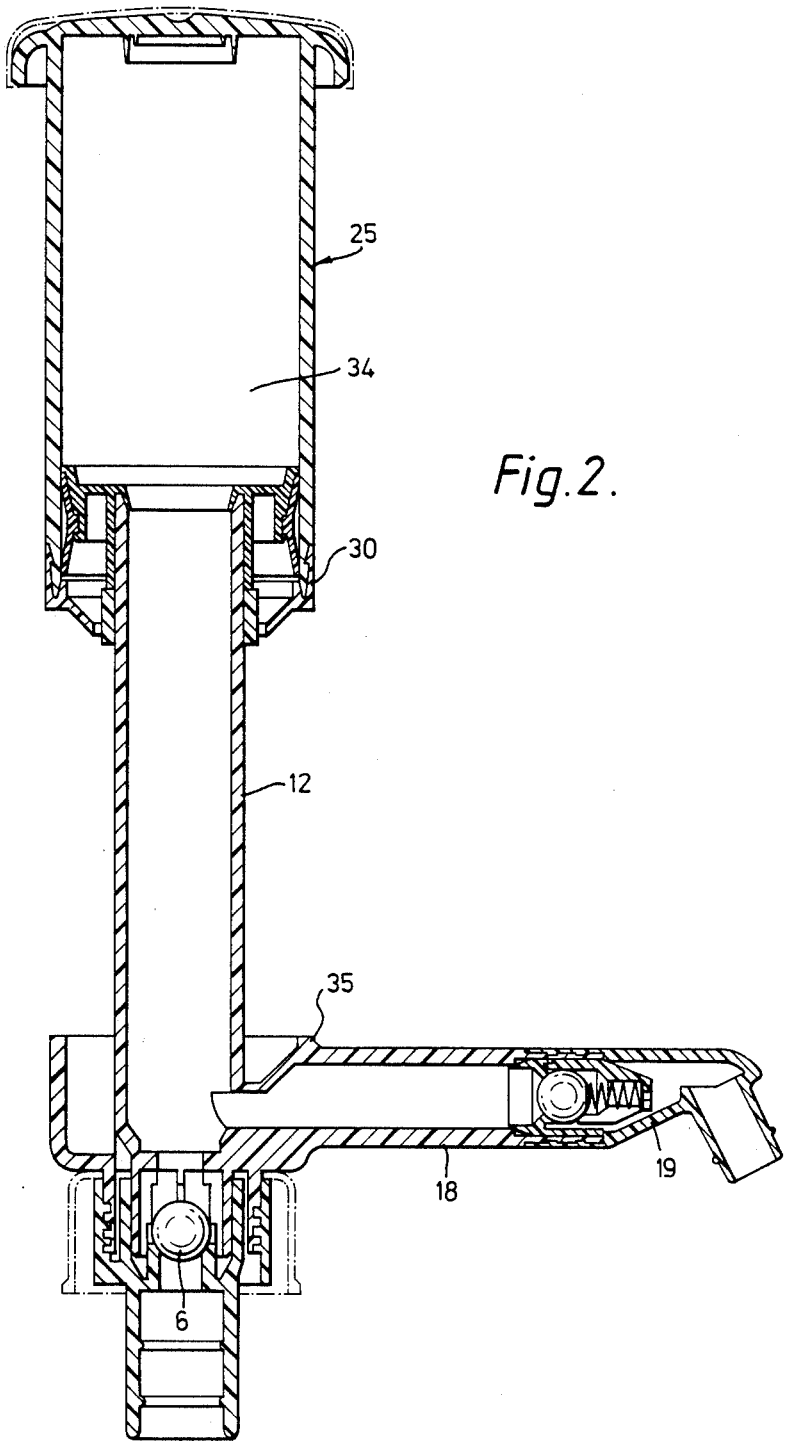
FIG. 2 is the same section on a slightly reduced scale showing the extended position of the cup and FIG. 3 is a section analogous to FIG. 1, showing a modification.

To operate the pump after it has been fitted, complete with a draw tube, to a container 1 of material to be dispensed, the cup 25 is lifted to the position shown in FIG. 2. The increase thereby caused in the volume of the pump chamber 34, to which air cannot gain access due to the hermetic seal of the ring 16 on the cup 25, causes material to be lifted past the inlet valve 6 to within the stem 12. When the cup is then pushed down again to the position of FIG. 1 the reduction of volume inside the pump chamber 34 causes the material to be forced out through the stem 18 and nozzle 19 past the outlet valve 21, the inlet valve 6 being then closed.

If there is any leakage of material past the seal ring 16, that material will drain down the inside wall of the cup 25, down the conical part 31 of the collector ring 30 and then drop towards the bottom of the body part 9. The tendency for escaping to occur will be greatest of course during the down, compressive, stroke of the cup. Material will drop through the apertures 33 towards the flange 10 of the body part 9 and then drain through apertures 11' into the cavity formed between the skirt 8 and the middle ring 24. From this cavity it can escape through the apertures 11 back into the container.

It can also be seen, particularly from FIG. 2, that as the cup is being raised to its upper position and material is being withdrawn from the container, compensating air may pass through the now-open base of the body part 9 and through the same cavity between the skirt 8 and the middle ring 24 through the apertures 11. This drawing-in of air will tend to sweep in with the air any material which has collected in that cavity. Since the normal condition of the pump, especially during storage or being sent out, is with the cup closed down, at which time the collector ring 30 forms a sealing abutment with a ridge 35 (FIG. 2) on the body part, there will be little tendency for unwanted or contaminating material to enter the container in that way.

To prevent drip of the material from the nozzle if the dispenser pump is left in its closed condition but with a charge still partly in the stem 12 or nozzle 18, apart from the resistance of the spring loaded outlet valve 21, there is also the engagement between the annulus 28 and the innermost periphery of the collar 13 forming a further hermetic seal at that point. Thus even if the seal 16 is damaged, air cannot be drawn in to the upper end of the stem 12 to follow any tendency of a charge in that stem to settle downwardly, and it therefore is retained against a tendency to escape.

Figure 3:
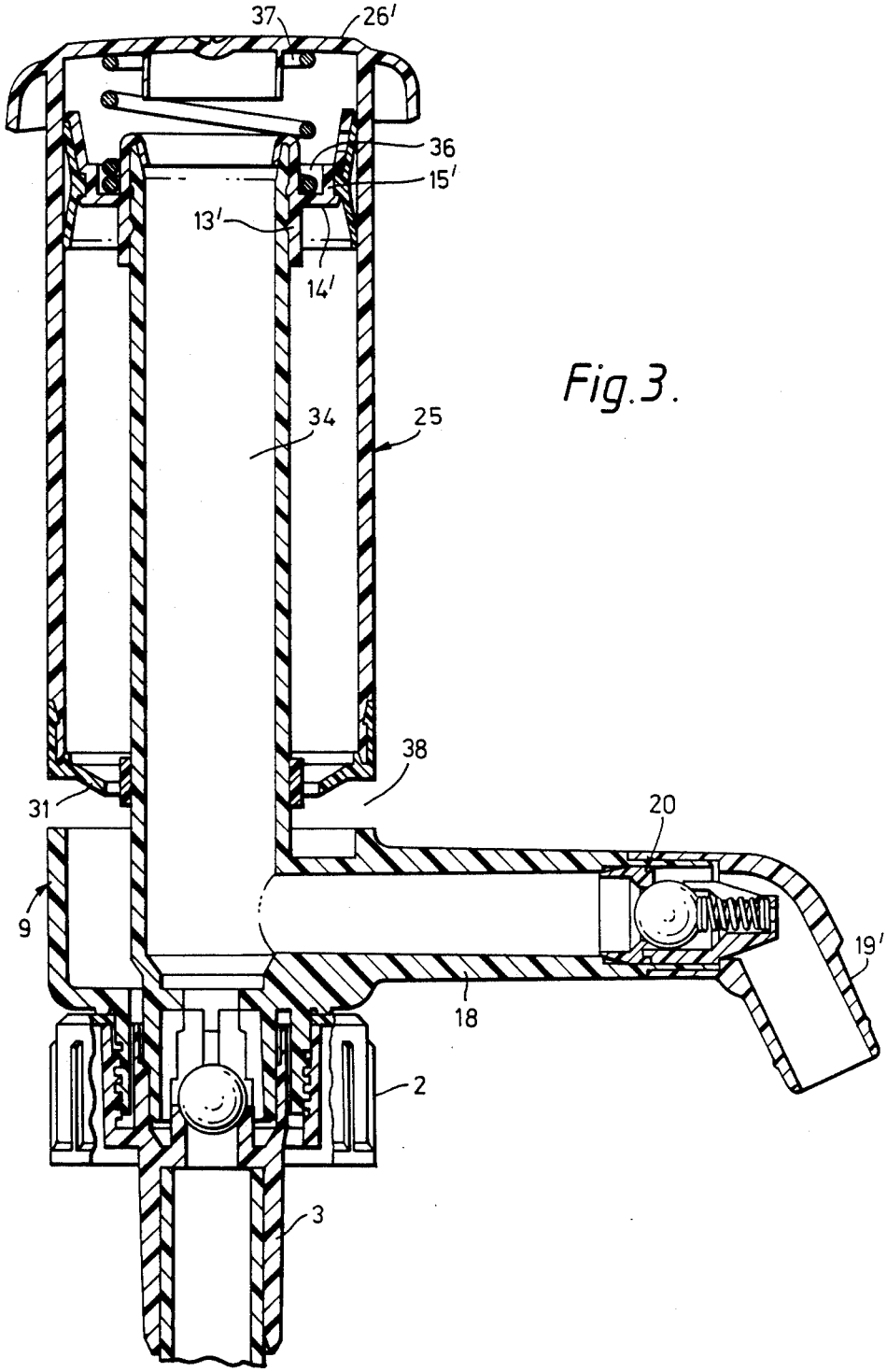

A modification, seen in FIG. 3, is useful if liquids being dispensed are particularly mobile.

A modified collar 13' is shown, which has a flange 14' about half-way along its axial length, and the mounting 15' is repositioned so that the seal ring 16 is in approximately the same axial position, relative to the collar, as in the previous embodiment. The channel 36 formed between the collar 13' and housing 15' receives a compression spring 37 trapped between the cup head 26' and flange 14'.

The purpose of the spring 36 is to cause a small backstroke of the cup as it is released after each depression, to open up the gap indicated at 38 before the cup comes to rest. This releives any remaining pressure in the pump chamber and may exert a slight suck back, thus seating the outlet valve firmly. Both of these measures militate against escape of any charge that might remain in the pump chamber 34 or nozzle 18.

Of course the modified collar, flange and mounting 13', 14', 15' may equally well be used in the first embodiment, without the interposition of spring 37.

FIG. 3 also shows a preferred conformation of nozzle end fitting 19', offering less possibility of retention of part of the material discharged through the valve 20.

We claim:

1. A dispenser pump comprising:

(a) a body;

(b) a hollow stem fast with the body and having a free end;

(c) a cup having a closed head, a skirt and a mouth;

(d) means mounting said cup over said stem for relative movement therebetween to and from a first extended position and a second closed position, said cup being mounted such that said mouth is around said stem and said head is beyond the free end of the stem;

(e) seal means fast with said stem and slidingly engaged with an inner surface of said skirt of said cup;

(f) a pump chamber having a volume defined by said stem and said cup between said stem, said skirt, said seal means, and said head;

(g) unidirectionally valved inlet and outlet means to and from said chamber whereby said relative sliding movement to cause variation in the volume of said pump chamber causes material to be pumped to be drawn into or out of said chamber through said inlet and outlet means respectively; and (h) collector means at said mouth of said cup, said collector means comprising a frusto-conical surface converging away from said head of said cup, and at least one aperture in a portion of said surface most remote from said head.

2. A dispenser pump as claimed in claim 1 wherein said collector means additionally comprises a guide collar slidingly engaged on said stem.

3. A dispenser pump as claimed in claim 1 wherein said body additionally comprises at least one aperture at a base thereof remote from said head of said cup.

4. A dispenser pump as claimed in claim 1 wherein said body includes trap means surrounding said stem, said trap means being for receiving material collected by said collector means and dropping from said at least one aperture.

5. A dispenser pump as claimed in claim 1 wherein said head of said cup bears an annulus for forming in said closed position of said cup a sealing engagement with said free end of said stem.

6. A dispenser pump comprising:

(a) a body;

(b) a hollow stem fast with the body and having a free end;

(c) a cup having a closed head, a skirt and a mouth;

(d) means mounting said cup over said stem for relative movement therebetween to and from a first extended position and a second closed position, said cup being mounted such that said mouth is around said stem and said head is beyond the free end of the stem;

(e) seal means fast with said stem and slidingly engaged with an inner surface of said skirt of said cup;

(f) a pump chamber having a volume defined by said stem and said cup between said stem, said skirt, said seal means, and said head;

(g) unidirectionally valved inlet and outlet means to and from said chamber whereby said relative sliding movement to cause variation in the volume of said pump chamber causes material to be pumped to be drawn into or out of said chamber through said inlet and outlet means respectively;

(h) said body additionally comprising means for attaching said body to a container of material to be pumped, said body and said mouth interabutting together in the closed position of the cup to define a body chamber, collector means at said mouth of said cup comprising at least one aperture for communicating with said body chamber; and (i) at least one aperture in said body for communicating between said body chamber and said container.

7. A dispenser pump as claimed in claim 6 further comprising a compression spring acting on said head of said cup to bias said cup to a rest position spaced from said second position.

* * * * *